United States Patent [19]

Craft, Jr.

[11] Patent Number: 4,972,966

[45] Date of Patent: Nov. 27, 1990

[54] STEP-ON WASTEBASKET

[75] Inventor: Charles W. Craft, Jr., Apple Creek, Ohio

[73] Assignee: Rubbermaid Incorporated, Wooster, Ohio

[21] Appl. No.: 464,452

[22] Filed: Jan. 12, 1990

[51] Int. Cl.[5] ..... B65D 43/26

[52] U.S. Cl. ..... 220/264; 220/263; 220/335; 220/337; 220/404; 220/908; 220/94 A

[58] Field of Search ..... 220/262, 263, 264, 1 T, 220/335, 337, 403, 404, 94 A; 4/251; 49/357

[56] References Cited

U.S. PATENT DOCUMENTS

| | | | |
|---|---|---|---|
| 2,001,445 | 5/1935 | Abele | 220/36 |
| 2,071,486 | 2/1937 | Wright | 220/36 |
| 2,096,506 | 10/1937 | Brandstrom | 248/147 |
| 2,456,840 | 12/1948 | Rogers et al. | 220/263 |
| 2,475,125 | 2/1948 | Brownell | 220/263 |
| 2,532,165 | 11/1950 | Hermani | 220/36 |
| 2,563,456 | 8/1951 | Brownell | 220/263 |
| 2,615,663 | 10/1952 | Hamilton | 248/147 |
| 2,811,329 | 10/1957 | Press et al. | 248/147 |
| 2,910,206 | 10/1959 | Hodgson | 220/17 |
| 2,946,474 | 7/1960 | Knapp | 220/17 |
| 3,008,604 | 11/1961 | Garner | 220/87 |
| 3,450,297 | 6/1969 | Clerk | 220/36 |
| 4,081,105 | 3/1978 | Dagonnet et al. | 220/263 |
| 4,119,240 | 10/1978 | Dumas et al. | 220/331 |
| 4,150,764 | 4/1979 | Anderson | 220/263 |
| 4,200,197 | 4/1980 | Meyer et al. | 220/263 |
| 4,303,174 | 12/1981 | Anderson | 220/263 |
| 4,445,619 | 5/1984 | Kubic et al. | 220/263 |
| 4,765,548 | 8/1988 | Sing | 241/101.3 |
| 4,785,964 | 11/1988 | Miller et al. | 220/263 |
| 4,865,214 | 9/1989 | Koda et al. | 220/263 |

*Primary Examiner*—Stephen Marcus
*Assistant Examiner*—Stephen Cronin
*Attorney, Agent, or Firm*—Renner, Kenner, Greive, Bobak, Taylor & Weber

[57] ABSTRACT

A wastebasket (10) includes a base portion (11) with an open upper end and a cover (12) pivotally attached thereto. A lever (27) is pivotally attached to the base portion (11) and carries a link arm (30) near one end thereof so that pivoting the lever (27) moves the link arm (30) upwardly and downwardly. A pin member (35) is carried by the upper end of the link arm (30) and is received in a track (39) carried by the cover (12) through an access opening (40) positioned above the pin member (35) when the cover (12) is closed on the base portion (11). The pivotal movement of the cover (12) is limited by a handle (50) which extends rearwardly from the base portion (11) to a further extent than the cover (12) when it is fully open thus preventing the cover (12) from contacting any surface which might be adjacent to the handle (50). When used with a plastic liner (53), the liner (53) may be draped over the upper open edge of the base portion (11). Fins (54) carried by the cover (12) travel in trackways (18) located at the upper edge of base portion (11) during the pivotal movement of the cover (12) to push the liner (53) away from the track (39) and pin member (35) so that the liner (53) does not interfere with the operation thereof.

32 Claims, 9 Drawing Sheets

STEP-ON WASTEBASKET

TECHNICAL FIELD

This invention relates to a wastebasket which is opened and closed by actuation of a foot pedal by the user. More particularly, this invention relates to a wastebasket which is opened by one actuation of a foot pedal and which remains open until another actuation of the foot pedal closes the wastebasket.

BACKGROUND ART

Wastebaskets having a cover which is hinged to a base and opened by actuation of a foot pedal are known in the art. Such devices are advantageous in that the hands of the user are thus freed to conveniently carry trash to and deposit it in the receptacle.

Most prior art foot activated wastebaskets are of the single step variety whereby the user depresses a foot pedal to open the container and must continue to apply foot pressure to the pedal to maintain the container open. As such, the mobility of the user is limited in that he will not be able to move any appreciable distance to reach for additional trash to put into the container without removing his foot and thereby permitting the container to close necessitating that it be reopened with a subsequent foot pedal actuation. While some single step wastebaskets eliminate this problem by allowing the cover to swing substantially past ninety degrees and thereby stay open under the influence of gravity, such causes additional problems or inconveniences. First, most such devices must be manually closed. Moreover, such wastebaskets cannot be placed at their most usual position close to a wall because either the cover would not swing far enough to be maintained open or the cover would continually bump and rest against the wall potentially marring the finish thereof.

In response to the problems encountered with the single step foot activated wastebaskets, some foot activated wastebaskets have been developed wherein after opening the container via actuation of the foot pedal, the user's foot may be removed and the cover will stay open. A second actuation of the foot pedal will then close the cover when desired. However, these two step varieties quite often include a large number of complex parts, such as springs and the like, and are not only hard to assemble but also are otherwise unreliable in that the mechanisms will not always function as desired.

Typical of such two step varieties is the device shown in U.S. Pat. No. 4,785,964. In that device a pin rides in a multi-radiused enclosed slot with enlargements at the ends thereof in which the pin is intended to rest during the operational steps. Such a construction, however, is susceptible to misoperations as when, for example, the user depresses the foot pedal with light and slow pressure causing the pin to miss its proper engagement with one of the enlargements thereby rendering the foot pedal inoperative to open the cover.

In an attempt to alleviate such misengagement problems of the device of U.S. Pat. No. 4,785,964, a counterweight was added to urge the pin into the proper position within the slot as shown in U.S. Pat. No. 4,865,214. However, even with the addition of this counterweight, the frictional forces between it and other portions of the mechanism often prohibit it from performing in accordance with its intended purpose.

Moreover, the devices of U.S. Pat. Nos. 4,785,964 and 4,865,214 are not without other problems which are in need of solution. As a practical matter, the commercial units made in accordance with these patents are sold as multipiece units which are difficult to assemble, particularly by the end user. The separate actuating mechanism must be threaded into place in the slot at the same time an attempt is made to attach the cover to the base. If the cover is attached to the base before the actuating mechanism is in place, the actuating mechanism cannot be properly located. Thus, the user must first thread the actuating mechanism in place and then tediously attempt to locate the cover in place on its hinge without allowing the actuating mechanism to dislodge from its desired position.

Both of these devices, as well as many other prior art devices, likewise are plagued by the fact that the user is usually desirous of placing the wastebasket against a wall to save space in a room. As such, when the foot pedal is depressed the cover will tend to hit the adjacent wall which not only can mar the wall, but also, more importantly, will tend to tip the container forwardly away from the wall and toward the user with the potential of spilling the contents of the waste container.

Finally, in order to avoid frequent cleaning of the trash container, most users will line the container with conventional plastic refuse bags, supporting the same around the rim of the container. As such, these bags often interfere with and otherwise jam the operating mechanism. To avoid these occurrences, many manufacturers have molded a tongue-like projection into the lid which extends outwardly therefrom at the area of the operating mechanism to push the portion of the bag located near the operating mechanism away from the same as the cover is being closed. However, such a solution is not totally practical inasmuch as the projection not only renders the cover more difficult to mold, but also the covers cannot be conveniently stacked for economic shipment and retail display.

DISCLOSURE OF THE INVENTION

It is thus a primary object of the present invention to provide a wastebasket which is opened by a first actuation of a foot pedal and closed by a second actuation of a foot pedal of a construction whereby the user is assured that each actuation of the foot pedal will result in the desired opening or closing of the wastebasket.

It is another object of the present invention to provide a wastebasket, as above, which includes a minimum number of parts and is easy to assemble as well as economically shipped and displayed.

It is a further object of the present invention to provide a wastebasket, as above, which can be positively located relative to a wall so that upon opening, the cover will not engage the wall to potentially mar the wall or cause the container to tip away from the wall and spill the contents thereof.

It is an additional object of the present invention to provide a wastebasket, as above, which can be utilized with a plastic bag liner without fear that the liner will jam the operating mechanism and without detrimentally effecting the molding, shipment or display of the wastebasket.

These and other objects of the present invention, as well as the advantages thereof over existing prior art forms, which will become apparent from the description to follow, are accomplished by the means hereinafter described and claimed.

In general, a wastebasket according to the present invention includes a base portion with an upper open end and a cover pivotally attached to the base portion. A lever is pivotally mounted on the base portion and carries a link arm near one end thereof so that upon pivoting the lever the link arm will move upwardly and downwardly. A pin member is carried at the upper end of the link arm and is carried at the upper end of the base portion when the cover is closed on the base portion. A track is carried by the cover for operative engagement with the pin member. The track has an access opening positioned above the pin member when the cover is closed on the base portion so that when the lever is pivoted, the pin member enters the track through the access opening to pivot the cover with respect to the track.

The pivotable movement of the cover is limited by a handle member which extends rearwardly from the base portion to a further extent than the cover when it is in the fully open position thus preventing the cover from touching any surface, such as a wall, which might be adjacent to the rearward most extent of the handle member.

When used with a plastic liner or bag, the bag may be draped over and carried by the upper rim of the base portion. Fins carried by the cover travel in trackways formed in the rim upon the pivotal movement of the cover to push the bag away from the track and pin member so that the bag does not interfere with the operation thereof.

A preferred exemplary wastebasket incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
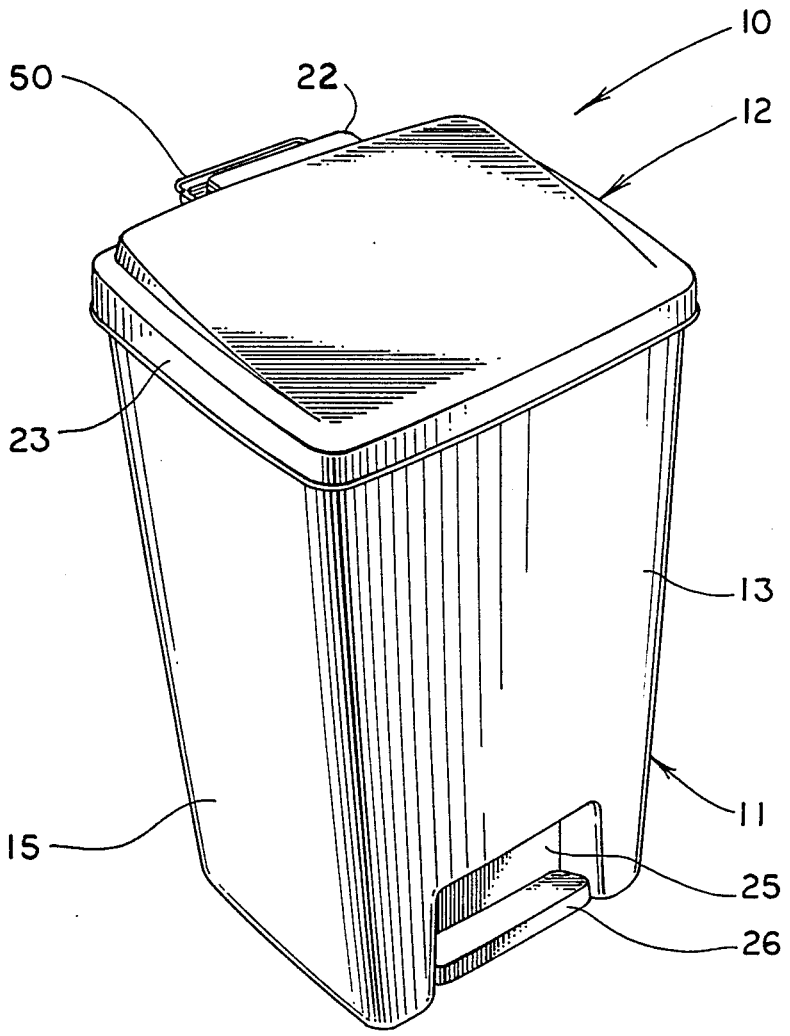
FIG. 1 is a perspective view of a wastebasket according to the concept of the present invention.

A wastebasket incorporating the concepts of the present invention is indicated generally by the numeral 10 in the drawings and includes a base portion, generally indicated by the numeral 11, for the containment of waste materials, and a cover generally indicated by the numeral 12. Base portion 11 thus includes front wall 13, rear wall 14, sidewalls 15 and a container bottom 16 thereby forming a receptacle with an open top. Base portion 11 and cover 12 are preferably made of any semi-rigid, easily molded plastic material.

Figure 2:
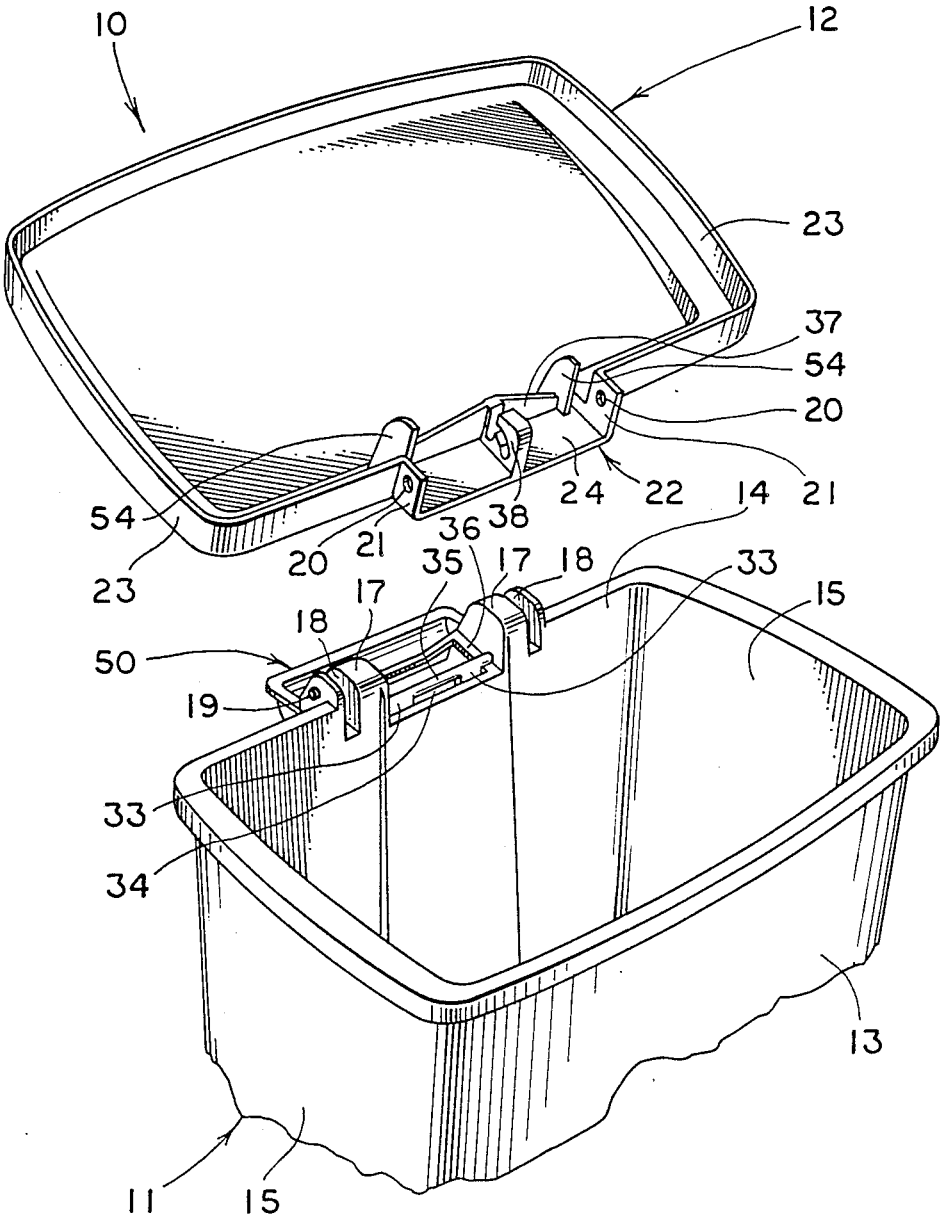
FIG. 2 is a fragmented perspective view showing the cover and the container base of the wastebasket of FIG. 1 in a disassembled condition.

As best shown in FIG. 2, the upper end of rear wall 14 has two shoulders 17 integrally formed therein. Shoulders 17 extend slightly upwardly from the open top of base portion 11 and extend rearwardly of rear wall 14. Each shoulder 17 includes trackways 18 formed therein, the purpose of which will be hereinafter described in more detail. The laterally outer edges of each shoulder 17 are provided with pin members 19 extending outwardly therefrom. Pin members 19 are received in apertures 20 in branches 21 of a U-shaped flange 22 which extends rearwardly outwardly from the downturned rim 23 of cover 12.

Base portion 11 and cover 12 are thus conveniently molded as separate pieces and can likewise be economically shipped and displayed in a disassembled condition. By merely flexing branches 21 of flange 22 slightly away from each other, apertures 20 can snap over pins 19 thus making cover 12 rotatable from a closed position on base portion 11 to an open position on an axis defined by pins 19. When in a closed position, shoulders 17 provide vertical support for the base 24 of U-shaped flange 22 which spans between branches 21.

Figure 3:
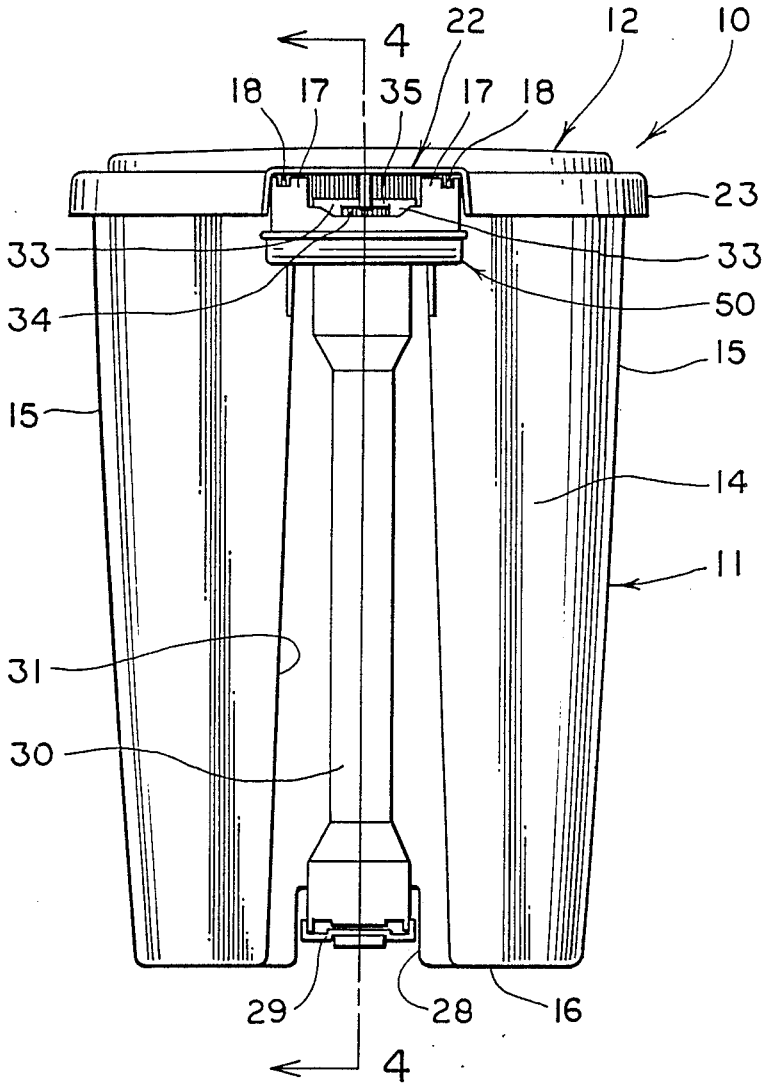
FIG. 3 is a rear elevational view of the wastebasket of FIG. 1.

Front wall 13 of container base portion 11 is provided with a recess 25 for foot access to a foot pedal 26. Foot pedal 26 is positioned at one end of a lever arm 27 (FIG. 4) which extends from the front of base portion 11 to the rear thereof through a passageway 28 (FIG. 3) formed below container bottom 16. The other end of lever arm 27 is conventionally pivotally connected, as at 29, to a link arm 30 which extends upwardly within a recess 31 in rear wall 14. Lever arm 27 is conventionally pivoted, as at 32, acting as a fulcrum so that whenever pressure is exerted on foot pedal 26, link arm 30 will be raised upwardly within recess 31 and whenever that pressure is removed from foot pedal 26, link arm 30 will return by gravity to the FIG. 4 position. By positioning link arm 30 within recess 31, it is flush within rear wall 14 and its operation cannot be accidentally obstructed.

The top of link arm 30 is forked having side tines 33 with a space 34 therebetween. An operating cam following pin 35 extends between tines 33 and across space 34. Cam following pin 35 also extends slightly laterally beyond both tines 33 and at those points rests on a ramp 36 formed at the top of recess 31 in rear wall 14 between shoulders 17. Ramp 36 is slightly downwardly inclined toward the top opening in container base portion 11 so that when at rest, that is, when there is no pressure on foot pedal 26, pin 35 will be in the forward position nearest to the top opening in container base portion 11 and in its initial operating position as will hereinafter be described.

Figure 5:
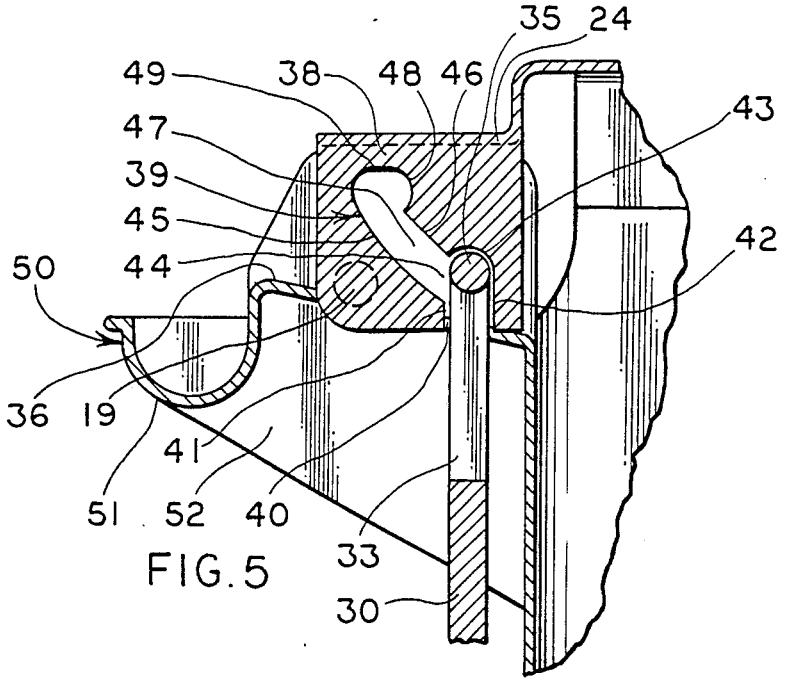
FIGS. 5—9, inclusive, are sequential views showing the operating mechanism depicted in FIG. 4 at various sequential positions during the opening and closing of the wastebasket.

As probably best shown in FIG. 2, a generally triangular brace plate 37 extends downwardly from cover 12 and with the base portion 24 of U-shaped flange 22 carries a cam plate 38. Cam plate 38 has a cam-like surface or track formed therein and generally indicated by the numeral 39. As best shown in FIGS. 5—9, inclusive, track 39 is continuous in nature having an access opening 40 at the bottom (when the cover 12 is closed on base portion 11 as shown in FIG. 5) thereof. At the point of access opening 40, track 39 is defined by two generally vertical opposed guide walls 41 and 42 which extend upwardly from opening 40. Guide wall 42 terminates at its upper end as on arcuate cover-opening lobe 43 of a curvature generally corresponding to the shape of pin 35. Lobe 43 is thus opposed to access opening 40 within track 39. An open area 44 is formed between the upper end of guide wall 41 and the end of lobe 43 opposite guide wall 42.

A pin directing wall 45 extends upwardly from the top of guide wall 41 and with an opposed directing wall 46, which extends upwardly from the end of lobe 43 opposite guide wall 42, forms a passageway 47 that extends, when plate 38 is oriented as shown in FIG. 5, upwardly from open area 44 at an angle of approximately 45° . Both directing walls 45 and 46 are arcuate in nature each being of one continuous curve, complementary to each other. The upper end of directing wall 46 terminates at the lower end of an arcuate cover-closing lobe 48 of a curvature generally corresponding to the shape of pin 35. Lobe 48 turns back on itself to form a pin resting position 49 at the upper end of directing wall 45 and opposed to lobe 48.

Figure 4:
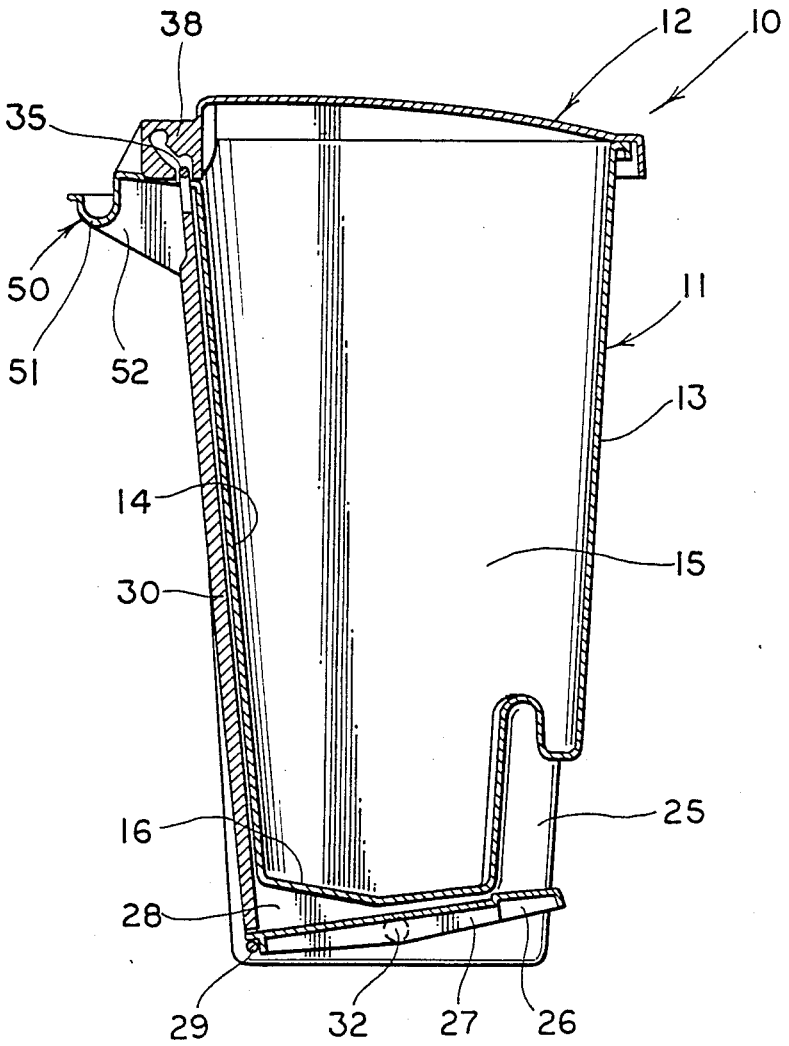
FIG. 4 is a sectional view taken substantially along line 4—4 of FIG. 3.

Having described the configuration of continuous track 39, the manner in which pin 35 cooperates with track 39 to open and close wastebasket 10 will now be described in detail. As shown in FIG. 4, with the mechanism at rest, that is, when cover 12 is in its normal closed position on base portion 11, pin 35 is positioned at the bottom of access opening 40. Such positioning is assured because pin 35 rests, at that time, at the lower end of the ramp surface 36.

Figure 6:
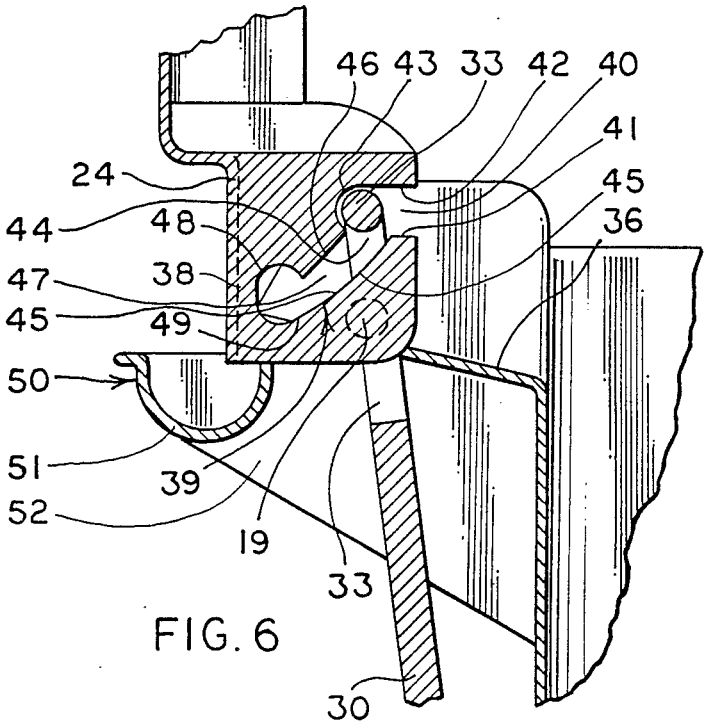

When it is desired to open wastebasket 10, pressure applied to foot pedal 26 raises link arm 30 as previously described and pin 35 moves upwardly until it engages cover-opening lobe 43, the position shown in FIG. 5. Such placement of pin 35 in lobe 43 is assured because pin 35 is guided in that direction between opposed vertical guide walls 41 and 42. Because lobe 43 is above the axis of cover hinge pin members 19, continued pressure on pedal 26 swings cover 12 open to the position shown in FIG. 6. It should be noted that FIG. 6 depicts the position of pin member 35 after cover 12 has been swung open but before pressure on pedal 26 is released.

Figure 7:
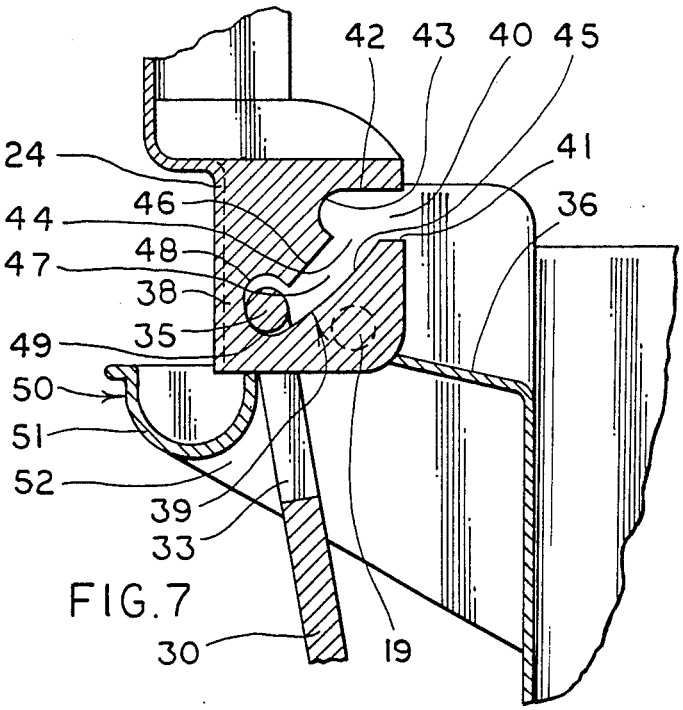
Figure 8:
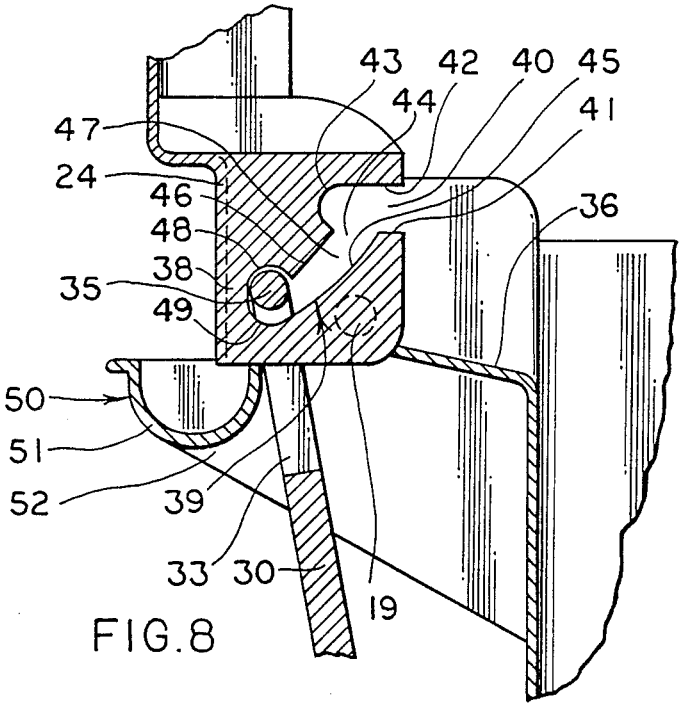
Figure 9:
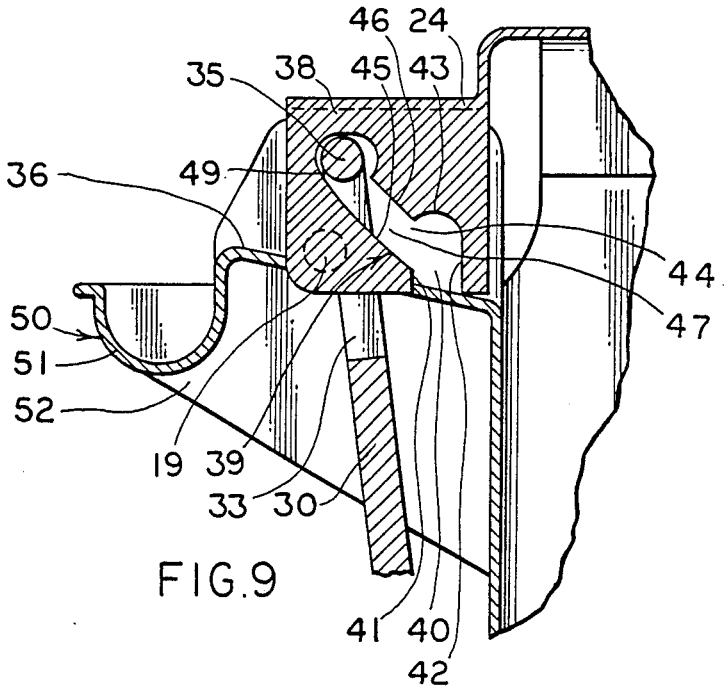
Figure 10:
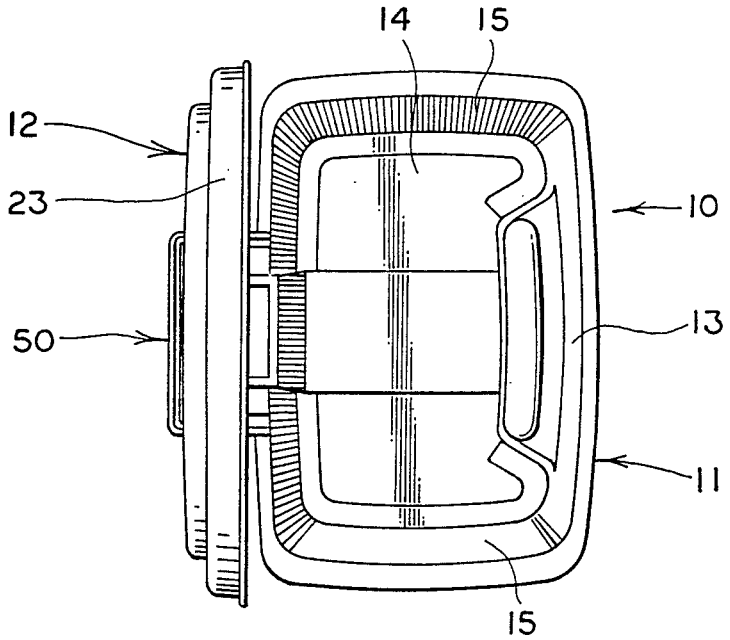
FIG. 10 is a top plan view of the wastebasket of FIG. 1 with the cover thereof in its fully open position.

With the cover now open, upon release of the foot pressure on pedal 26, link arm 30 now lowers and pin 35 falls through open area 44, contacts directing wall 45, and is guided through passageway 47 to the resting position 49 as shown in FIG. 7. FIG. 7 thus shows the relationship of the operating mechanism, that is, the relationship of pin 35 to track 39 at the time wastebasket 10 is at its at rest, open condition. As such, pin 35 is directly below cover closing lobe 48 and upon the next actuation of foot pedal 26, pin 35 is raised into lobe 48, as shown in FIG. 8. Because lobe 48 is now above and on the other side of the axis of cover hinge pin members 19, continued pressure on pedal 26 swings cover 12 to its original closed position as shown in FIG. 9. It should be noted that FIG. 9 depicts the position of pin member 35 after cover 12 has been swung closed but before pressure on pedal 26 is released. Upon subsequent release of pressure on pedal 26, link arm 30 lowers and pin 35 falls onto directing wall 45, through open area 44 and into its starting position at the bottom of access opening 40.

It should be appreciated that if desired cover 12 can be opened or closed manually without detracting from or interfering with the next foot pedal operation. For example, if one were to manually swing cover 12 on pins 19, pin 35 would remain resting at the bottom of ramp surface 36 and outside of track 39 while cover 12 would be oriented as shown in FIGS. 6, 7 or 8. From that position, cover 12 could, of course, be manually closed but if instead the operator would depress foot pedal 26, pin 35 would be raised without immediate movement of cover 12. However, a slight release of pressure on pedal 26 will cause pin 35 to drop into track 39 to the FIG. 7 position whereupon further foot pressure will close cover 12. Similarly, if cover 12 is opened by the actuation of foot pedal 26, with the components resting as shown in FIG. 7, a manual closure of cover 12 merely returns pin 35 to its normal ready-to-operate position at the bottom of access opening 40.

It should also be appreciated that the mechanism just described is easy to assemble. As previously described, to attach cover 12 to base portion 11 all the user need do is flex branches 21 of flange 22 slightly away from each other to snap apertures 20 onto pins 19. Because link arm 30 and pin 35 carried at the top thereof are a permanent part of base portion 11, after cover 12 has been attached to base portion 11, pin 35 will be resting at the bottom of sloped ramp 36 and it is automatically in position below access opening 40 for immediate operating engagement with track 39 upon actuation of pedal 26.

Wastebasket 10 can also be provided with a handle member generally indicated by the numeral 50. Handle 50 extends rearwardly from and between the lower portion of shoulders 17 at the top of base portion 11 and includes a grip portion 51, generally U-shaped in section, and two spaced support flanges 52 extending rearwardly from rear wall 14 from a point generally below each shoulder 17 to each end of grip portion 51.

In addition to serving the normal function of a handle enabling wastebasket 10 to be easily and conveniently transported, handle member 50 serves several other functions. First, it serves for a stop to the swinging movement of cover 12. Handle 50 is thus positioned so that it is engaged by the outer rear edge of base 24 of U-shaped flange 22 of cover 12 just after cover 12 is swung past vertical, preferably about 5° past vertical so that it will stay open when desired.

Moreover, handle 50 is designed to extend rearwardly to a further extent than any portion of cover 12 when it is fully opened. As such, when wastebasket 10 is placed against a wall, its usual location for storage, the closest it can be located relative to the wall is defined by the rearward extent of handle 50. Therefore, since handle 50 extends further rearwardly than cover 12 in the open position, cover 12 will never hit an adjacent wall when being opened.

Finally, because handle 50 extends across between shoulders 17 of base portion 11 and behind the operating mechanism, it serves to protect the operating mechanism from damage which might be caused were the operating mechanism directly exposed.

Figure 11:
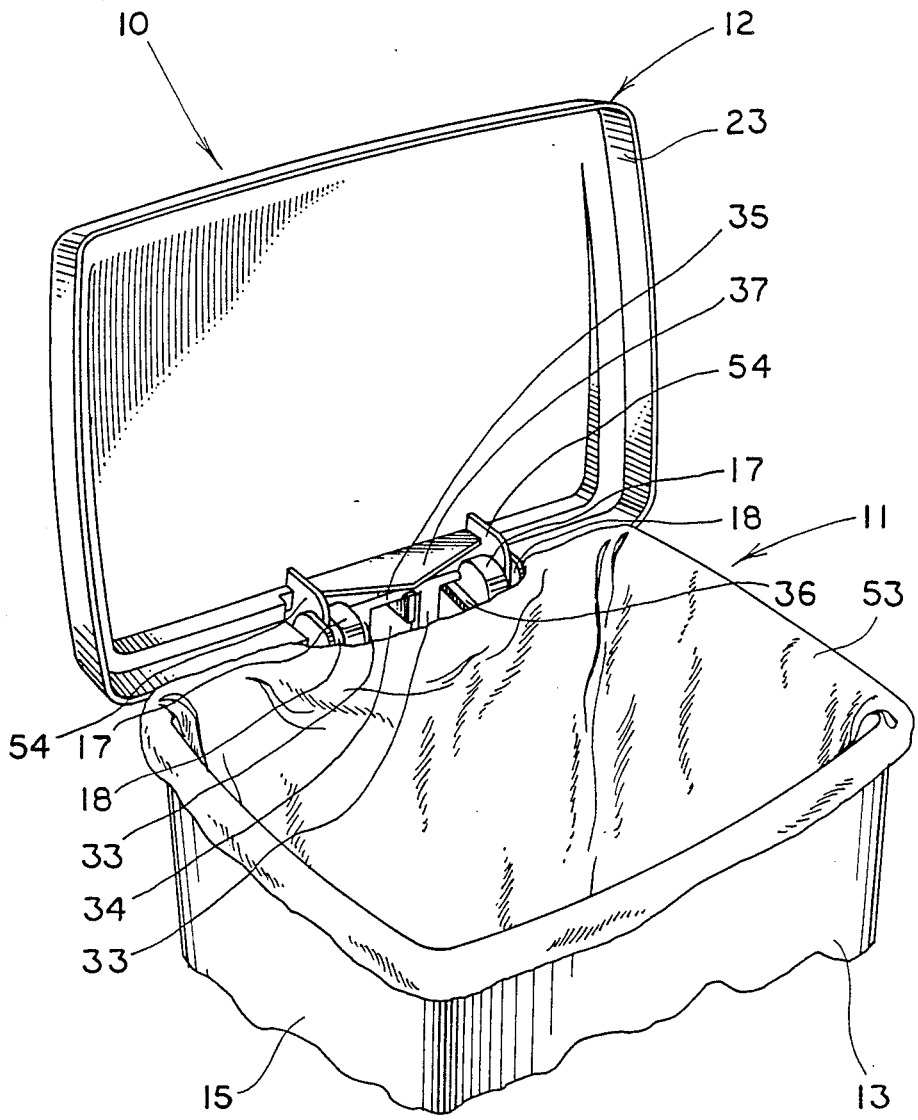
FIG. 11 is a perspective view of the wastebasket of FIG. 1 with the cover open and showing the use of the wastebasket with a plastic bag liner.
Figure 12:
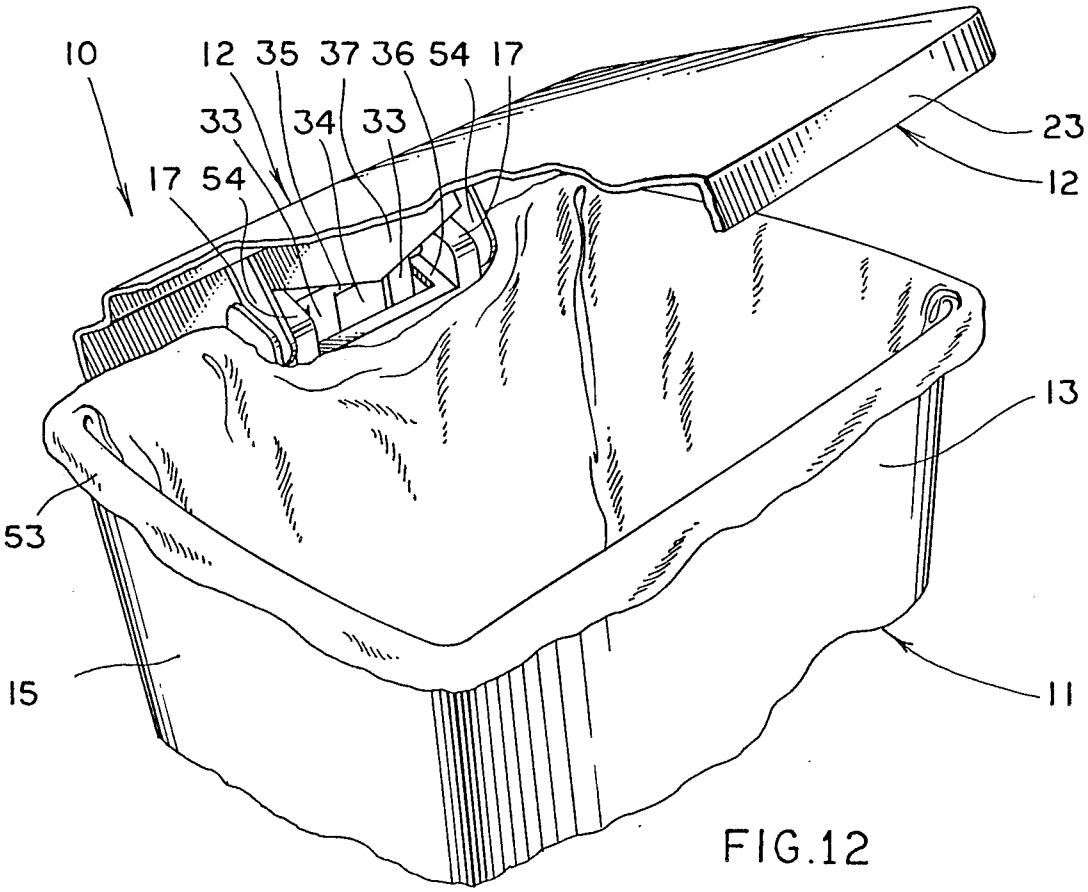
FIG. 12 is a cutaway view showing the manner in which the plastic bag liner is kept away from the operating mechanism as the cover is being closed on the container base.

While wastebasket 10 can be used without any type of disposable liner, many users prefer to contain waste materials in conventional disposable plastic bags. The manner in which wastebasket 10 is particularly suited for such usage is shown in FIGS. 11 and 12. There, a bag 53 is shown as being positioned in base portion 11 with the upper open end thereof being draped over the upper rim of base portion 11. Normally, the user would have to take special care while installing such a bag so that the portion thereof adjacent to the operating mechanism would not clog or otherwise jam the mechanism upon closing the cover. However, when utilizing wastebasket 10, no such special care need be taken and as such, as shown in FIG. 11, the user can effortlessly allow the upper edge to drape over the entire periphery of base portion 11, even over shoulders 17 and the like, without fear of jamming the mechanism. This is due to the fact that the underside of cover 12 is provides with fin members 54 which are supported by cover 12 as well as base 24 of flange 22 at the outer edges of triangular brace plate 37. As such, fins 54 are aligned with and adapted to ride within trackways 18 in shoulders 17. Thus, when cover 12 is closing on base portion 11, as shown in FIG. 12, fins 54 push bag 53 away from the operating mechanism and, as necessary, will continue to do so upon each closure of wastebasket 10.

It should thus be evident that the objects of the present invention are accomplished by the wastebasket just described thereby substantially improving the art.

I claim:

1. A wastebasket comprising a base portion with an upper open end, a cover pivotally attached to said base portion, a lever mounted on said base portion for pivotal movement, a link arm connected near one end of said lever and movable generally upwardly and downwardly upon the pivotal movement of said lever, pin means to assist in pivoting said cover and carried at the upper end of said link arm and positioned at said upper end of said base portion when said cover is closed on said base portion, and track means carried by said cover for operative engagement with said pin means, said track means having an access opening positioned generally above said pin means when said cover is closed on said base portion so that when said lever is pivoted, said pin means enters said track means through said access opening to pivot said cover with respect to said base portion.

2. A wastebasket according to claim 1 further comprising ramp means positioned near said upper open end and sloped toward said open end of said base portion, and supporting said pin when said cover is closed on said base portion.

3. A wastebasket according to claim 1 further comprising pedal means connected to the other end of said lever to pivot said lever.

4. A wastebasket according to claim 1 wherein said track means includes generally vertical guidewalls extending upwardly from said access opening.

5. A wastebasket according to claim 4 wherein said track means includes a lobe above said guidewalls and opposed to said access opening, said pin means being guided by said guidewalls to engage said lobe to pivot said cover to an open position away from said base portion upon first pivotal movement of said lever.

6. A wastebasket according to claim 5 wherein said track means includes a directing wall extending from said access opening and opposed to said lobe after said cover has been pivoted to an open position away from said base portion

7. A wastebasket according to claim 6 wherein said track means includes a pin resting portion at the end of said directing wall opposite to said access opening, said pin means moving along said directing wall to said pin resting portion upon a second pivotal movement of said lever in a direction opposite to the first pivotal movement.

8. A wastebasket according to claim 7 wherein said track means includes a second lobe opposed to said pin resting portion, said second lobe being engaged by said pin means upon a third pivotal movement of said lever in a direction opposite to the second pivotal movement to pivot said cover to a closed position on said base portion.

9. A wastebasket according to claim 8 whereby said directing wall is positioned so as to be opposed to said second lobe such that upon a fourth pivotal movement of said lever in a direction opposite to the third pivotal movement said pin means moves along said directing wall toward said access opening.

10. A wastebasket according to claim 1 further comprising spaced shoulders extending upwardly and rearwardly from said upper open end of said base portion, said pin means being positioned generally between said spaced shoulders.

11. A wastebasket according to claim 10 further comprising handle means for carrying the wastebasket extending between said spaced shoulders and extending rearwardly from said base portion.

12. A wastebasket according to claim 11 wherein said handle means stops and limits the pivotal movement of said cover by engaging said cover upon the opening thereof away from said base member.

13. A wastebasket according to claim 12 wherein said handle means extends further rearwardly from said base member than said cover when said cover is being engaged by said handle means.

14. A wastebasket according to claim 1 further comprising shoulders extending upwardly and rearwardly from said upper end of said base portion, fin members extending downward from said cover, and trackway means in said shoulders to receive said fin members as said fin members pass therethrough upon the pivotal movement of said cover with respect to said base member.

15. A wastebasket comprising a base portion with an upper open end, a cover pivotally attached to said base portion, means to pivot said cover from a closed position on said upper end of said base portion to an open position slightly rearwardly of said base portion, and handle means for carrying the wastebasket extending rearwardly from said base portion to a further extent than said cover when said cover is in the open position.

16. A wastebasket according to claim 15 further comprising means on said cover to engage said handle means to limit the opening pivotal movement of said cover.

17. A wastebasket according to claim 15 wherein said means to pivot includes a lever mounted on said base portion for pivotal movement, a link arm connected near one end of said lever, and operating mechanism means on said cover and on the upper end of said link arm to, upon pivotal movement of said lever, pivot said cover.

18. A wastebasket according to claim 17 wherein said base portion includes a rear wall, a recess in said rear wall, said link arm being within said recess, said handle means extending across said recess to protect said link arm.

19. A wastebasket according to claim 17 wherein said operating mechanism means includes pin means on said link arm to assist i pivoting said cover, and track means carried by said cover for operative engagement with said pin means.

20. A wastebasket according to claim 19 wherein said handle means includes spaced support flanges on each side of said pin means extending rearwardly from said base portion, and grip means extending between said spaced support flanges.

21. A wastebasket according to claim 20 further comprising a ramp surface between said support flanges, said pin means resting on said ramp surface.

22. A wastebasket according to claim 19 wherein said track means includes an access opening positioned above said pin means when said cover is closed on said base portion so that when said lever is pivoted, said pin means enters said track means through said access opening to pivot said cover with respect to said base portion.

23. A wastebasket according to claim 22 wherein said track means includes guidewalls extending upwardly from said access opening and a lobe above said guidewalls opposed to said access opening.

24. A wastebasket according to claim 23 wherein said track means includes wall means extending from said lobe and said access opening to direct said pin means away from said lobe and said access opening.

25. A wastebasket according to claim 24 wherein said track means includes a pin resting portion opposed to a second lobe, said pin resting portion and said second lobe being at the end of said wall means opposite from said lobe and said access opening.

26. A wastebasket adapted to contain a bag member comprising a base portion with a rim at its upper open end for engaging the bag member, a cover pivotally attached to said base portion; operating means near said rim to pivot said cover from a closed position on said base portion to an open position; trackways formed in said rim adjacent said operating means, and fin means carried by said cover and movable in said trackways during the pivotal movement of said cover to assure that the bag member carried by said rim does not interfere with said operating means.

27. A wastebasket according to claim 26 wherein said rim includes spaced shoulder members extending upwardly and rearwardly from said base portion, said trackways being positioned in said shoulder members.

28. A wastebasket according to claim 27 wherein said operating means includes a track carried by said cover and pin means selectively operatively engaging said track and further comprising a ramped surface extending from each of said shoulder members and downwardly inclined toward said rim, said pin means resting on said ramped surface.

29. A wastebasket according to claim 28 further comprising handle means for carrying the wastebasket positioned between said shoulder members at the upper end of said ramped surface.

30. A wastebasket according to claim 28 wherein said track includes an access opening positioned above said pin means when said cover is closed on said base portion and when said pin means is positioned at the lower end of said ramped surface.

31. A wastebasket according to claim 30 further comprising a link arm carrying said pin means at one end thereof, a lever mounted on said base member for pivotal movement and carrying said link arm at one end thereof so that upon pivotal movement of said lever, said link arm is raised and lowered.

32. A wastebasket according to claim 30 wherein said fin means push the bag member away from a position above said pin means so that said pin means may enter said track through said access opening upon pivotal movement of said lever.

* * * * *